United States Patent [19]

Stump

[11] Patent Number: 4,569,274

[45] Date of Patent: Feb. 11, 1986

[54] SINGLE SPRING FLUID CYLINDER WITH MOTION BUFFER

[75] Inventor: Lee E. Stump, Brooklyn Park, Minn.

[73] Assignee: Timesavers, Inc., Minneapolis, Minn.

[21] Appl. No.: 715,374

[22] Filed: Mar. 25, 1985

[51] Int. Cl.[4] ..... F15B 15/22

[52] U.S. Cl. ..... 92/9; 92/12; 92/84

[58] Field of Search ..... 92/9, 12, 84, 143

[56] References Cited

U.S. PATENT DOCUMENTS

| | | | |
|---|---|---|---|
| 1,706,812 | 3/1929 | Pfau | 92/9 |
| 1,740,818 | 12/1929 | Killingsworth | 92/84 |
| 2,338,974 | 1/1944 | Schmidt | 92/84 |
| 3,176,801 | 4/1965 | Huff | 92/9 |
| 3,532,106 | 10/1970 | Greune et al. | 92/12 |
| 4,481,868 | 11/1984 | Stump | 92/12 |

*Primary Examiner*—Paul E. Maslousky

*Attorney, Agent, or Firm*—Orrin M. Haugen; Thomas J. Nikolai

[57] ABSTRACT

An improved double-acting fluid cylinder with primary and secondary chambers of tandem construction, wherein the primary chamber is utilized to provide ram motion in a first direction and wherein the tandemly arranged secondary chamber is provided with a single biasing spring means to resiliently bias the secondary piston and to buffer and control the rate of motion induced in the ram, and also to drive the ram in a direction opposite the stroke of the first direction and at a time subsequent to the stroke so as to temper the ultimate amplitude or extent of motion induced in the ram in response to forces applied within the primary chamber.

4 Claims, 2 Drawing Figures

SINGLE SPRING FLUID CYLINDER WITH MOTION BUFFER

BACKGROUND OF THE INVENTION

The present invention relates generally to an improved double acting fluid cylinder of tandem chamber construction, wherein a primary chamber is utilized to provide an initial stroke and main motion in the ram directed along a first direction and wherein a tandemly arranged secondary chamber is provided with a resiliently biased and hydraulically dampened secondary piston to buffer, control and temper the rate and extent of motion induced in the ram by the initial stroke and to provide limited secondary reverse motion in an amount proportionally less than the motion of the initial stroke. This action serves to temper the amplitude or ultimate extent of motion induced in the ram in each operational event.

The present invention constitutes an improvement over that certain device and system described and claimed in U.S. Pat. No. 4,481,868, "Fluid Cylinder with Motion Buffered Ram Assembly". In accordance with the present invention, a single spring is utilized to achieve the control of motion in the secondary piston, thus providing a system in which the overall length can be reduced and thus permit installation in smaller spaces and volumes.

Fluid actuated cylinders are utilized for a wide variety of purposes. The operating parameters of cylinders are determined, to a great extent, by the type of operating fluid utilized, the operating pressure and capacity of the source, as well as the manner in which the fluid is controlled while being delivered to the chambers. The cylinder arrangement of the present invention, being tandem, is designed for use preferably with a pulsed pneumatic source in the primary chamber, to achieve quick initial stroke with a partial overdriven or overextended response, and with a hydraulic fluid and a spring or mechanical bias being provided in the secondary chamber, for buffering, modifying and tempering the ultimate response of the overall cylinder to the pulsed input, thus providing an air-hydraulic combination cylinder with desirable operational characteristics.

As indicated, fluid actuated cylinders are utilized for a variety of purposes. The design of the present air-hydraulic combination cylinder makes it particularly adapted for use with devices requiring a rapid initial drive or stroke response to an indicating signal, with the initial drive phase or stroke being slightly overdriven or overextended response followed by a subsequent relaxation phase wherein a portion of the ram motion induced in the initial phase is reversed.

The cylinders of the present invention are particularly adapted for use in controlling and steering high speed webs such as endless abrasive belts or the like which move or travel at high rates of speed in an orbital path along two or more drums which define the orbit. In a typical two drum orbital arrangement for an abrasive belt, one drum drives the belt, with the second or idler drum preferably being used as a "tracking" roll or drum for the system. Because of the high rates of speed normally involved in such orbital webs or belts, highly responsive steering corrections are required in order to control, steer and properly track the web along its orbital path and limit the extent to which the belt will wander or otherwise experience axial run-off.

Most abrasive belt tracking systems employ at least two sensors in order to properly steer the web, one being disposed at each lateral edge of the normal tracking path of the belt. Since the sensors employed normally respond to the occurrence of an abnormal tracking condition, it is normally necessary to oversteer the tracking device to be able to correct the run-out and at the same time properly steer or guide the web along a desired axial path. Because of the high speeds involved, the correctional response or motion must be undertaken rapidly in order to prevent axial run-off of the belt. In order to prevent ultimate over-correction or constant hunting of the system, it has been found desirable to control or steer the web with a correctional cycle which includes two separate phases, the initial phase consisting of an over-adjustment or overly extended rapid drive pulse, i.e., one of excessive magnitude, followed by a relaxation phase which consists of a partial reversal somewhat slower than the initial drive pulse. The over-adjustment occurring in the initial phase is designed to reverse the direction of "wander" of the belt. The relaxation or buffer phase permits partial reversal of the initial over-adjustment with the reversal preferably occurring at a somewhat slower rate than that taking place in the initial phase. In other words, in the initial phase of the correctional cycle, a first over-adjustment pulse is delivered to the cylinder to cause the ram to rapidly move in a first direction, and during the relaxation phase, a partial and relatively slow reversal of motion of the ram occurs. In the air-hydraulic combination cylinder of the present invention, the initial over-adjustment stroke or pulse is obtained by the action of the primary pneumatic chamber, with the primary piston providing the rapid initial response in the ram along a first operational direction. Thereafter, in the relaxation phase a reversal of motion occurs to accommodate and mollify the initial over-adjustment. In a typical belt control application, therefore, the initial over-adjustment is sufficient to immediately correct and reverse the axial travel condition of the belt to prevent run-off, with the relaxation or reversal phase being undertaken to accomplish some residual correction of the axis of travel. In this fashion, control of the web and/or belt is achieved by establishing a new operating datum point for the tracking system each time a belt travel correction event or cycle occurs.

The improved air-hydraulic combination cylinder of the present invention is uniquely adapted for belt tracking control, among other applications where response of the above type is desired, indicated or required. Typically, the improved air-hydraulic cylinders of the present invention include a single housing and ram with tandemly arranged primary and secondary chambers. A double-acting ram is slidably mounted within both chambers of the housing, and primary and secondary piston members are operatively coupled to the ram within the responsive chambers. The primary chamber has a pair of primary fluid ports in communication therewith delivering primary fluid thereto, in this case pneumatic fluid. While steady-state delivery of pneumatic fluid may be utilized in some applications, the device of the present invention is particularly adapted for use with pulses of fluid delivered thereto. Since, the primary fluid ports are typically disposed on opposite sides of the primary piston, double-acting motion of the primary piston and ram may be achieved. The secondary chamber is provided with a pair of secondary fluid ports, with these ports being arranged on opposite sides of the secondary pistons. A fluid conduit directly interconnects the secondary ports, one to another, to hydraulically couple the opposed ends of the secondary chamber together and to permit hydraulic fluid to move therethrough at a controlled rate in response to motion of the secondary piston. The secondary piston is resiliently coupled to the ram through a single compression, so that the ram may move in direct response to the primary piston, and in time-delay response relative to the secondary piston. The motion of the secondary piston relative to the ram is dependent upon forces generated in the spring, with movement of the secondary piston forcing hydraulic fluid through the interconnecting conduit to mutually opposed sides of the piston. Accordingly, the motion of the ram is buffered in both its rate and amplitude, with the buffering action occurring as a result of forces generated in the resilient spring member of the motion buffer assembly interconnecting the ram and the secondary piston and through transfer of hydraulic fluid due to movement of the secondary piston within the secondary chamber.

SUMMARY OF THE INVENTION

Therefore, it is a primary object of the present invention to provide an improved fluid cylinder means of tandem design, wherein both primary and secondary chambers are utilized to control motion of a double-acting ram, and wherein a primary chamber is utilized to receive pulses of compressed fluid to provide the primary motion to the ram, and wherein a secondary chamber together with a simplified ram motion buffer assembly is provided to temper the motion both with respect to rate and ultimate extent or amplitude of motion.

It is yet a further object of the present invention to provide an improved air-hydraulic combination cylinder employing tandemly arranged primary and secondary chambers, and wherein the primary chamber produces a rapid stroke or response in the form of an over-travel of the ram along a first direction of motion, and wherein the secondary chamber provides a buffering action which produces relaxation and modest reversal of motion of the ram along a second or opposite direction, and with the relaxation motion induced by the secondary chamber being at an adjustable controllable lower rate and at a proportionally smaller magnitude than that of the initial over-travel motion, thereby achieving a new operational datum point for the ram which is slightly offset from the original starting point of the ram at the initiation of the operational cycle.

Other and further objects of the present invention will become apparent to those skilled in the art upon a study of the following specification, appended claims and accompanying drawings.

DESCRIPTION OF THE PREFERRED EMBODIMENT

Figure 1:
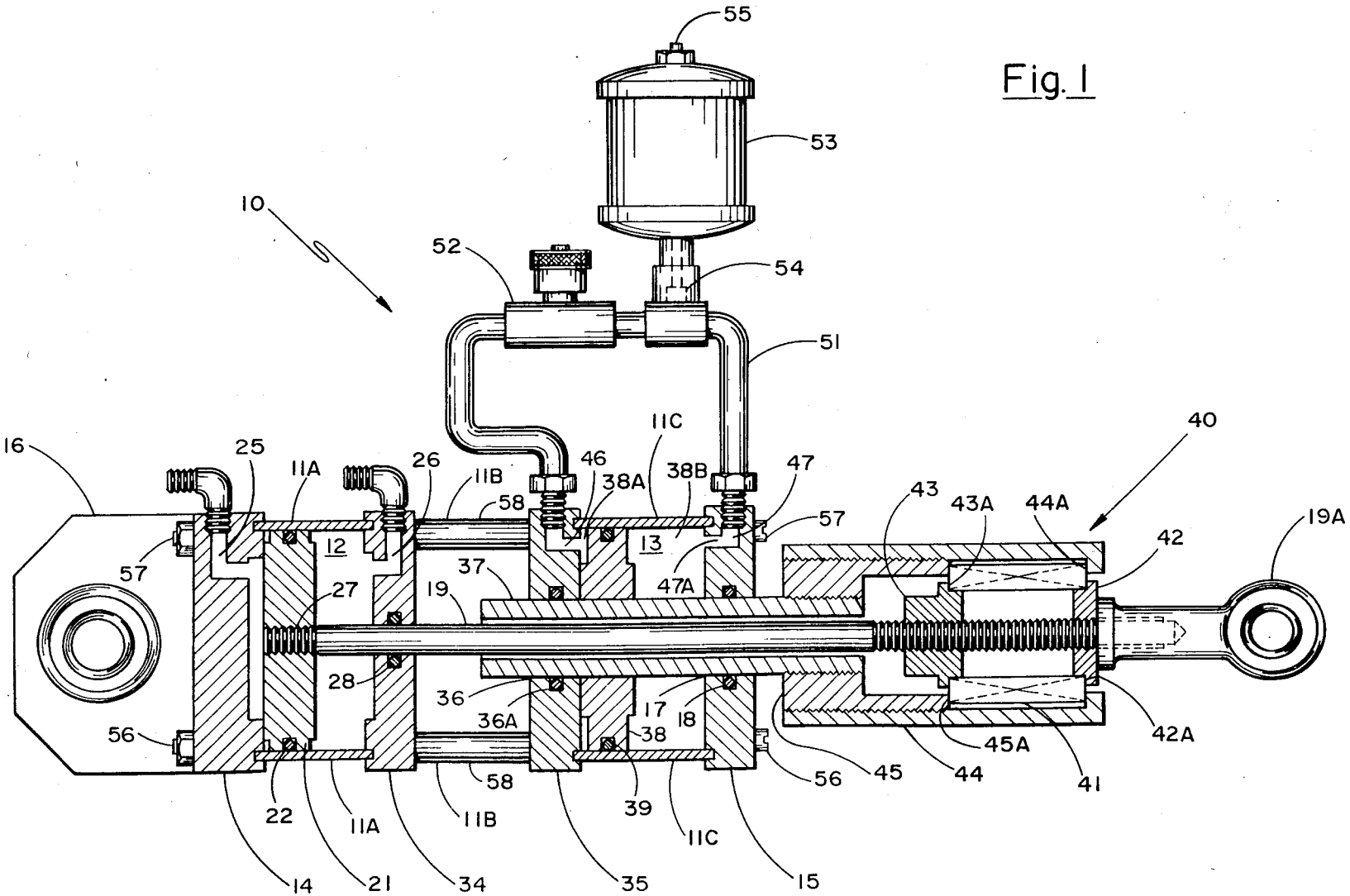
FIG. 1 is a sectional view taken through the diameter of a fluid cylinder assembly prepared in accordance with the preferred modification of the present invention.

In accordance with the preferred embodiment of the present invention, and with particular attention being directed to FIG. 1 of the drawings, the fluid cylinder means generally designated 10 includes a housing 11, comprising sections 11A and 11C, cylindrical in form, having axially aligned primary and secondary chambers 12 and 13 disposed therewithin. A spaced opening or zone is provided between chambers 12 and 13, with this opening being defined by four sleeve spacers, such as is illustrated at 11B—11B. Also, end caps are provided as at 14 and 15, with end cap 14 having a mechanically coupling member 16 secured thereto, and with end cap 15 having a bore therewithin as at 17, provided with appropriate seals as at 18. Ram 19 is disposed within the tandemly aligned primary and secondary chambers 12 and 13, with ram 19 being, of course, arranged for double-acting motion within the chambers. With attention being directed to primary chamber 12, it will be observed that this chamber is provided with a primary piston as at 21, with piston 21 being appropriately sealed to the inner walls of chamber 12 with a circumferential seal such as at 22. Seal 22 may typically be an "O" ring. Ports 25 and 26 communicate with chamber 12, and provide a means for introducing and exhausting fluid under pressure to chamber 12 to drive piston 21. Typically, ports 25 and 26 will be provided with fittings to couple fluid pressure lines thereto. In the operation of the fluid cylinder 10, pneumatic fluid under pressure will normally be coupled to ports 25 and 26 and controllably introduced thereto and exhausted therefrom in typical double acting fashion. Ram 19 is appropriately coupled to piston 21 by means of the threaded engagement shown at 27. In order to preserve the operational and integrity of the system, a typical "O"-ring seal will be provided as at 28 to isolate the chamber 12 from atmosphere.

An intermediate chamber-separating annular ring is provided at 34. Ring 34, as indicated, is provided with a central bore, and with a seal being disposed therewithin as at 28, the seal being held in place within a groove formed within ring 34. Port 26 is, as indicated, disposed within ring 34 to supply air or other gaseous fluid to one side of the primary chamber 12. A second annular ring, in the form of an intermediate annular ring is provided as at 35, with ring 35 being spaced from ring 34 by means of either sleeve spacers 11B, or alternatively a shroud sleeve. Annular ring 35 is utilized as one wall of secondary chamber or spacer opening 13 as is more fully explained hereinafter.

A center or axial port is provided in ring 35 as at 36 for sealing and otherwise maintaining the integrity of secondary chamber 13, the function of which is to slidably receive hollow piston rod 37 therewithin. The "O"-ring 36A is utilized as a seal.

Secondary chamber 13 is, as indicated, disposed within sleeve 11C and end cap 15 and annular ring 35. Ram 19 extends through the entire extent of secondary chamber 13, and as is apparent, secondary piston 38 is disposed therewithin. Secondary piston 38 separates secondary chamber 13 into a pair of opposed chamber portions such as at 38A and 38B, with chamber portions 38A and 38B being isolated, one from another by means of sealing ring 39. As is apparent, chambers 38A and 38B are arranged on generally oppositely disposed ends of the secondary chamber 13, separated by the secondary piston 38.

Secondary piston 38 is resiliently coupled to ram 19 through a single biased compression spring member such as at 41. This spring member permits the secondary piston 38 to move axially relative to ram 19 and responsive to forces generated on piston 21 within the primary chamber 12. Resilient spring 41 is provided with a reasonable radial dimension, and is held in place by pairs of cooperating internal and external shoulder surfaces. Specifically, it will be apparent that the secondary piston 38 is operatively coupled to the ram 19 by means of a ram motion buffer assembly generally designated 40.

The ram motion buffer assembly 40 comprises a first load adjusting means secured to ram 19 and including a pair of axially spaced apart spring caps including a first cap 42 and a second spring tension adjusting cap 43. As is apparent, caps 42 and 43 are provided with spring contact shoulders as at 42A and 43A for making contact with the inner radial portion of compression spring 41. As is apparent in the drawing, cap 42 is threadably engaged upon ram 19, as is cap 43, with cap 43 functioning as a spring tension adjustment member, depending upon the adjusted disposition of member 43 on ram 19.

The ram motion buffer assembly further includes a load transfer means secured to the secondary piston, with the assembly including sleeve 37 the outer diameter of which is fast to internal diameter of secondary piston 38. In this connection, sleeve 37 comprises an elongated sleeve with inner and outer axial ends, and with the inner end portion being secured to or fast on secondary piston 38, as indicated. The outer axial end portion of the load transmitting means includes an expanded sleeve portion 44 which is, in turn, coupled along its internal diameter to compression spring 41. Specifically, the internal flange area as at 44A makes contact with the outer radially extending portions of spring 41, with the contact surface of flange 44A being generally in alignment with the contact surface 42A of spring cap 42. Also, threaded sleeve 45 is provided internally of sleeve 44, with sleeve 45 extending to and terminating in abutment surface 45A. Abutment surface 45A makes contact with the radially outwardly extending portions of spring 41, and the contact surfaces 45A lie in general radial extension and in alignment with spring contacting surface 43A of spring tension adjustment member or cap 43. In this fashion, it is possible to adjust the axial disposition of member 45 relative to the disposition of member 43, so as to provide alignment between surfaces 43A and 45A.

Ports 46 and 47, along with an annular clearance zone between the surface of piston 38 and the inner surface of end cap 15 provide communication in the fluid circuit portion of the invention. In addition, a port may be utilized as an auxiliary port for air-bleeding from the system. Therefore, ports 46 and 47 together with the recessed space 47A provide primary communication with chamber portions 38A and 38B, respectively. The ports 46 and 47 are interconnected by means of fluid conduit 51 in order to control the rate of transfer of fluid between chambers 38A and 38B. A control means is provided as at 52 to meter the flow of fluid through conduit 51, with control means 52 preferably being in the form of a needle valve. The amplitude of motion of the ram 19 is controlled in part by the forces available from spring 41, with the extent of the motion achieved during the relaxation phases of the operational cycle being controlled by the metering valve 52. Also, for maintaining a constant supply of fluid within the system, automatic fluid filler such as at 53 is provided. These fluid filler systems, which are commercially available, automatically maintain and/or replenish hydraulic fluid which may be lost from the system during normal operation. A check valve is normally provided as at 54 for controlling operation of the automatic filler mechanism. Also, for bleeding air from the system, a bleeder assembly may be provided as at 55.

While any typical assembly techniques may be utilized, the arrangement of the present invention may include a system wherein the end caps 14 and 15, along with the intermediate rings 32 and 35 may be welded to the cylinder portions 11A, 11B and 11C, with screws such as at 56 and 57 being provided to complete the assembly with four tie rods as at 58—58. Also, assembly by tie rods and screws will permit inspection and repair of the cylinders when necessary. While in the example of FIG. 1, part 11B was defined as a sleeve element, it will be appreciated that four sleeve spacers may be provided over the individual tie rods 58—58 to achieve integrity of the assembly. For purposes of explanation, however, the portion 11B was indicated as sleeve spacers, it being understood that this portion of the device may alternatively be in the form of a solid sleeve or shroud.

The terminal end of ram 19 may be in the form of a rod end or eye as at 19A. Rod end 19A may be secured to rod 19 by threaded engagement, as indicated.

Figure 2:
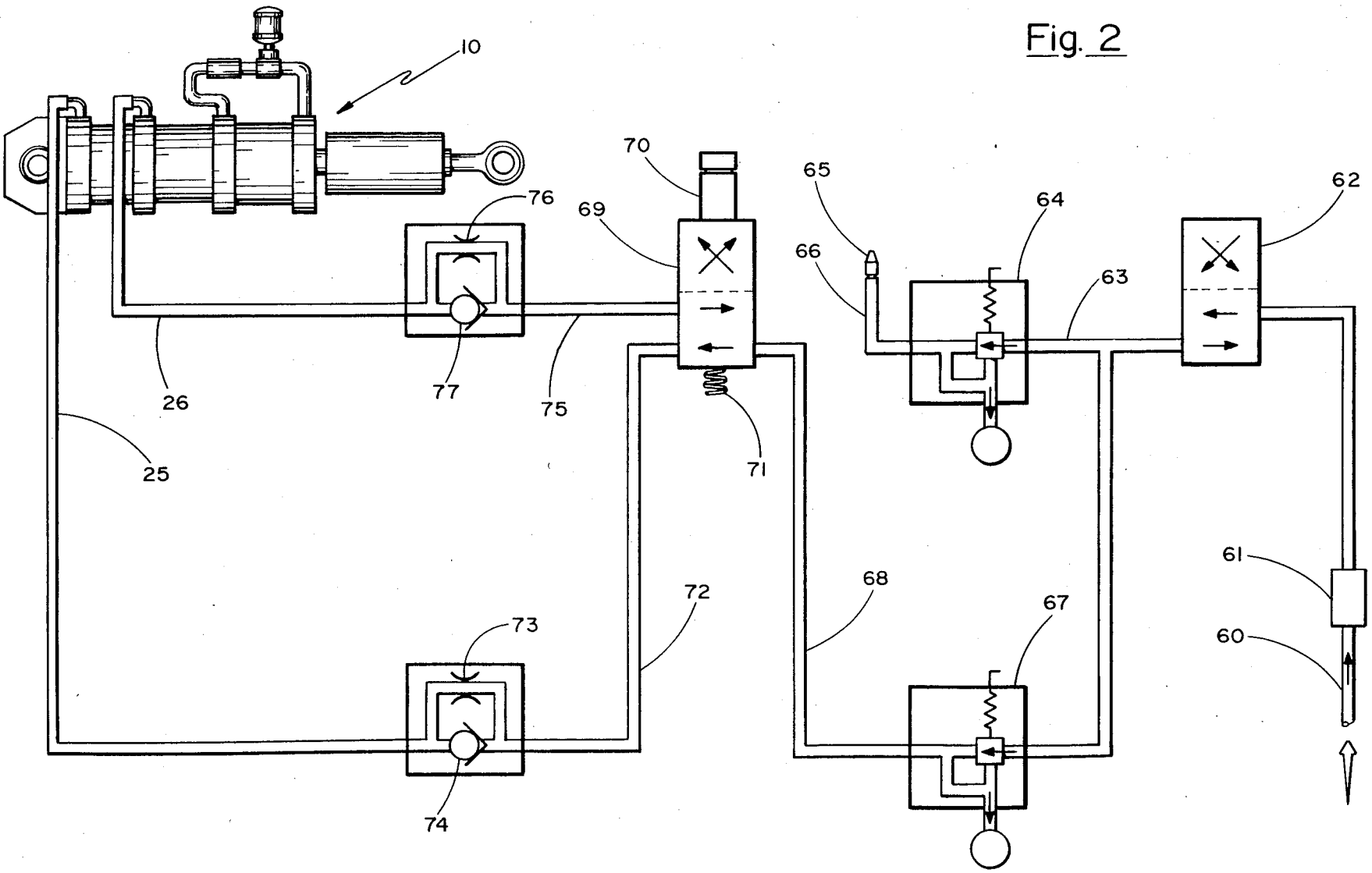
FIG. 2 is a schematic diagram illustrating the fluid cylinder assembly of the present invention arranged in combination with a typical circuit for controlling the action of the cylinder.

Attention is now directed to FIG. 2 wherein a typical system for an operational environment is illustrated. This operational environment is selected from a portion of the operational grinding machine disclosed and claimed in U.S. Pat. No. 3,504,458, Richard D. Rutt, assigned to the assignee of the present invention with the exception of the tracking cylinders, it being appreciated that the tracking cylinders of the present invention are substituted for those illustrated in U.S. Pat. No. 3,504,458. Referring now to the diagrammatic showing of FIG. 2, it will be observed that fluid cylinder means 10 is coupled to an operative hydraulic circuit including a source of pneumatic fluid under pressure as at 60, which is connected to a source, such as air or the like, and provided with a typical filter as at 61. For most applications, it is normally sufficient for lines connecting ports 25 and 26 to be controlled through solenoids which admit air under pressure, when required, and are otherwise normally vented to atmosphere. In other words, the inertia and normal resistance encountered in the fluid portion of the device is adequate to hold the cylinder in a desired position excepting for those occasions when a change or adjustment is indicated.

With respect to the system illustrated, in FIG. 2, therefore, pressure line 60 is further connected to control valve 62 having a spool valve portion, the position of which is controlled by a switch on a control panel, not shown, for either directing or exhausting air from ongoing pressure line 63. Pressure line 63 is connected to release valve 64 which, in turn, is connected to air discharge jet 65 for discharging air to atmosphere through conduit 66. Also connected to lines 63 is a release valve 67 which, in turn, is connected by means of conduit 68 to a directional valve 69 having a spool valve, the position of which is controlled by a solenoid 70 and a spring member 71.

Leading from directional valve 69 is a conduit 72 connected to port 25 of cylinder 10, conduit 72 being provided with a restricted passageway 73 therein to slow the flow of compressed air in one direction, but may be bypassed in the return direction by a conduit utilizing check valve 74. Also leading from directional valve 69 is the second conduit 75 connected to port 26 of fluid cylinder 10, conduit 75 being provided with a restricted passageway 76 therein to slow the flow of compressed air in one direction, but which may be bypassed in the return direction by a conduit having a check valve 77 therewithin. As is indicated, conduits 73 and 76 are disposed in operative parallel relationship with supply conduits 72 and 75, respectively.

In the operational embodiment, a sensor of the type typically used for belt tracking purposes, such as an air jet of the type disclosed in Rutt U.S. Pat. No. 3,504,458 may be utilized. Alternatively, electronic systems utilizing photo-responsive sensors may be employed. In either event, these sensors are utilized to activate or control solenoids 70 to displace spool valve within the direction valve 69 to connect conduit 68 to conduit 75 to supply a pulse of compressed air to port 26 while exhausting port 25. Ram 19 is moved inwardly to the left in response, so as to move the track roll of a belt tracking system in an appropriate direction to properly control the tracking motion of the belt. When the control system calls for a correction in the opposite direction from that earlier described, a second tracking sensor of the type illustrated in Rutt U.S. Pat. No. 3,504,458 or a photoelectric sensor will de-energize solenoid 70, allowing spring 71 to displace spool valve within directional valve 69 and apply a pulse of compressed air to the port 25 and exhaust through port 26, to cause axial motion in the belt, and drive the belt laterally in the opposite direction to achieve the proper correction.

Turning now to the details of the cylinder illustrated in FIG. 1, when a pulse of air under pressure is provided to the left portion of piston 21 of chamber 12 through port 25, ram 19 is moved outwardly in response to the introduction of air under pressure. Thus, ram 19 will be caused to move to the right in the view of FIG. 1, and secondary piston 38 moves to the right as well but to a lesser amplitude. The motion of secondary piston 38 is not co-extensive with the motion of ram 19, since spring 41 is compressed through motion of cap 43. When the effects of the pulse of compressed air being applied to port 25 are terminated, the spring 41 which was compressed, will relax and slowly return to equilibrium through reverse movement of ram 19 and piston 21. This motion is in a reverse direction, or to the left in FIG. 1, to a point which approaches, but which is not as far to the left as it was in its original position at the beginning of the cycle. Oil, which preferably fills chambers 38A and 38B is caused to move through interconnecting conduit 51, and thus functions to diminish the quantity held in one of the chamber portions, while increasing the quantity held in the other. This displacement of fluid occurs while the primary piston is under the influence of the pulse of air entering the primary chamber, thus displacing hydraulic fluid to the opposite side of the piston 38. The displacement of hydraulic fluid is at a controlled and preferably slow rate with the displacement being dependent upon the setting of metering valve 52. Thus, secondary piston 38, the hydraulic piston, will move or shift to a new location in response to the forces induced upon it, and with the motion being damped by the displacement of a quantity of hydraulic fluid. Following the termination of the application of the pulse of compressed fluid through port 25, secondary piston 38 will cause ram 19 to move in a reverse direction during the relaxation phase of the correctional cycle.

Valve 52, the metering valve, will control and limit the speed as well as the distance that piston 38 can travel during the initial phase of each correctional cycle, and thus the magnitude of the differential motion resulting from each correctional cycle or belt-track controlling event.

As has been indicated, when controlling and steering rapidly moving orbital webs or abrasive belts, it is necessary to initially overadjust or steer the tracking device so as to be able to correct the belt track rapidly enough to prevent run-off of the belt. Accordingly, each time a steering or tracking correction is called for, secondary piston 38 modified the initial over-adjustment through a relaxation phase of the correctional cycle, whereby the position controlling ram undergoes a modest change of axial position at the end of each correctional cycle. After a number of tracking corrections have been made in and along the same direction, the combined action of the primary piston along with the modifying and relaxation action of secondary piston 38 will cause ram 19 to be disposed in a new and proper position, and the rapidly moving web will be tracked and held generally along a desired travel path or axis. Also, drifting of ram 19 will be limited and controlled by the action of the secondary piston within its hydraulic loop.

In one typical operational embodiment, the cylinder is provided with an initial correctional pulse which is adequate to move the ram outwardly at a distance of approximately 0.100 inch, with this amplitude representing the over-correction portion of the operational cycle. Thereafter, the cylinder is permitted to recover through motion in the opposite direction generated by the secondary cylinder by a distance of approximately 90% of the amplitude of the over-correctional portion of the cycle. The amplitude of motion which is achieved by the over-correcting pulse is determined by certain of the operating parameters, including the pressure available at the source, along with the time duration of the applied pulse. The magnitude and/or extent of reverse motion is determined by the setting of the metering valve in the hydraulic portion of the system.

In order to preserve operational integrity, it is desirable that the axial length of the secondary chamber be at least about equal to that of the primary chamber 12. Such geometric designs assist in preventing cocking or misalignment of the piston 38 in its chamber, and also in extending the life of the seals to preserve operating integrity and metering control.

It will be appreciated, of course, that the fluid cylinder design of the present invention has a number of applications, is adaptable for a variety of uses, and is, of course, highly suited for the belt tracking application as described herein.

I claim:

1. In a fluid cylinder means comprising a housing with tandemly arranged primary and secondary chambers formed therein, a double-acting ram slidably mounted within said housing and having primary and secondary piston members operatively coupled thereto with the primary chamber having first and second primary fluid ports communicating therewith for controlling the flow of primary fluid to and from said first chamber, and with the primary piston member being disposed within said primary chamber and with said first and second primary fluid ports being disposed on opposite sides of said primary piston and with the secondary chamber having first and second secondary fluid ports communicating therewith for controlling the flow of secondary fluid to and from said secondary chamber, the secondary ports being arranged in generally oppositely disposed side ends of said secondary chamber, and with said secondary piston being disposed between said first and second secondary ports, and fluid conduit means directly interconnecting said first and second secondary ports, one to another, the improvement comprising:

(a) said secondary piston being resiliently coupled to said ram through a load transmitting means comprising a single biasing spring means with inner and outer radially spaced diameters for permitting said secondary piston to move axially relative to said ram and responsive to forces generated in said biasing spring member while forcing fluid through said fluid conduit means to opposed sides of said secondary piston;

(b) said load transmitting means comprising first loading adjustment means secured to said ram and including a pair of axially spaced apart spring caps with spring contacting shoulders arranged along the outer periphery thereof and being positioned against the radially inwardly disposed portion of said compression spring, said spring caps being adjustably positionable along said ram so as to retain the ends of said compression spring at predetermined positions along said ram;

(c) said load transmitting means further including an elongated compression sleeve with inner and outer axial ends and with the inner end being coupled to said secondary piston and with the outer axial end being operatively coupled to said compression spring, said elongated sleeve means including a pair of axially spaced apart spring retaining shoulders for positioning against the radially outwardly disposed portion of said compression spring;

(d) the arrangement being such that when said ram is moved in response to fluid forces within said primary chamber, the rate and extent of the motion of said ram in response to forces induced within said primary chamber is buffered in response to forces generated in said resiliently biased members coupled to said secondary piston within said secondary chamber.

2. The fluid cylinder means as defined in claim 1 being particularly characterized in that flow rate control means are disposed within said fluid conduit means for metering the flow of fluid therethrough.

3. The fluid cylinder means as defined in claim 1 being particularly characterized in that said primary chamber is coupled to a source of pneumatic fluid under pressure.

4. The fluid cylinder means as defined in claim 3 being particularly characterized in that said secondary chamber is provided with hydraulic fluid.

* * * * *